United States Patent [19]

Schürmann et al.

[11] Patent Number: 4,819,892

[45] Date of Patent: Apr. 11, 1989

[54] YARN CARRIER FOR WINDING A FILAMENTARY THREAD AND A METHOD OF FORMING A THREAD RESERVE

[75] Inventors: Hans Schürmann, Emmen; Walter Settele, Lucerne, both of Switzerland

[73] Assignee: Viscosuisse SA, Emmenbrücke, Switzerland

[21] Appl. No.: 70,914

[22] Filed: Jul. 9, 1987

[30] Foreign Application Priority Data

Jul. 11, 1986 [CH] Switzerland ..... 02797/86

[51] Int. Cl.[4] ..... B65H 54/02; B65H 54/34; B65H 75/24; B65H 75/28

[52] U.S. Cl. ..... 242/18 PW; 242/118.4; 242/118.41; 242/125.1; 242/164

[58] Field of Search ..... 242/118.4, 118.41, 118.6, 242/118.61, 125, 125.1, 125.2, 125.3, 164, 165, 166, 167, 18 PW, 18 A, 25 A

[56] References Cited

U.S. PATENT DOCUMENTS

| | | | |
|---|---|---|---|
| 2,048,995 | 7/1936 | Clinton | 242/125.1 |
| 2,970,789 | 2/1961 | Binns | 242/125.1 |
| 3,285,530 | 11/1966 | Kirchner, Jr. et al. | 242/125.1 |
| 3,658,275 | 4/1972 | Lahmann | 242/125.1 X |
| 4,076,185 | 2/1978 | Dorph . | |
| 4,165,055 | 8/1979 | Dee . | |
| 4,387,863 | 6/1983 | Edmonston et al. | 242/118.4 |
| 4,542,862 | 9/1985 | Romike et al. | 242/118.4 X |
| 4,603,820 | 8/1986 | Olofsson | 242/164 X |
| 4,659,032 | 4/1987 | Rottleb . | |
| 4,667,896 | 5/1987 | Frey et al. | 242/118.41 |

FOREIGN PATENT DOCUMENTS

| | | | |
|---|---|---|---|
| 569662 | 11/1975 | Switzerland . | |
| 804793 | 11/1958 | United Kingdom | 242/125.1 |
| 2079247 | 1/1982 | United Kingdom | 242/125.1 |

*Primary Examiner*—Stanley N. Gilreath
*Attorney, Agent, or Firm*—Felfe & Lynch

[57] ABSTRACT

A yarn carrier for winding a filamentary thread having a cylindrical barrel with conical ends and two annular grooves on the inside of the barrel conical end, and a take-up ring disposed for coaxial displacement on one of the ends. The inside surface of the take-up ring is provided with an annular detent adapted to snap into one of the two grooves.

11 Claims, 1 Drawing Sheet

YARN CARRIER FOR WINDING A FILAMENTARY THREAD AND A METHOD OF FORMING A THREAD RESERVE

BACKGROUND OF THE INVENTION

The invention relates to a yarn carrier for winding a filamentary thread, consisting of a cylindrical barrel with conical ends and a method for forming a thread reserve.

Yarn carriers made of plastic and having a stiff, hollow cylindrical body and conical ends are known for use as quills (Swiss Pat. No. 569,662). Such yarn carriers can also be referred to as "biconical yarn carriers" and differ from symmetrical-end yarn carriers in that their bodies assume a greater diameteer toward the outer ends. Biconical-end yarn carriers have proven practical for winding monofilaments of medium thickness (approximate diameter 0.05 to 0.3 mm), but they have the disadvantage that the thread reserve that is necessary for problem-free further processing of the monofilament is not provided. The thread reserve, however, is indispensable in the automatic changing of a thread from a yarn carrier that has become empty to a full yarn carrier. If there is no thread reserve on the conical yarn carrier, interruptions will occur in the weaving.

It is the object of the invention to design a biconical yarn carrier such that a thread reserve can be taken onto it.

It is another object to design the yarn carrier such that the thread in the thread reserve will not be damaged in transport.

It is also another object to made the thread reserve of the full spool simplyand quickly usable.

SUMMARY OF THE INVENTION

The object is achieved according to the invention by disposing a take-up ring for coaxial displacement on the end of the yarn carrier.

The yarn carrier and take-up ring are preferably of a stable plastic. They can, however, also be made of any other durable material.

It is desirable that the diameter of the barrel not differ substantially from that of the take-up ring, since the circumferential velocity of the thread reserve must be approximately equal to that of the yarn carrier at the beginning of the winding. It is therefore advantageous for both diameters to be approximately equal.

It is also desirable to provide the inside of the conical end of the barrel with at least two annular grooves into which an annular detent on the take-up ring can snap.

Openings between the tonguesof the take-up ring have, on the one hand, the advantage that the weight is reduced, and on the other hand that the leftover thread can be removed simply with a scissors. The axially disposed fingers give the ring the desired elasticity, by enabling it to be easily snapped into the barrel and to be rejoved from it just as easily.

It is desirable to provide the outer end of the take-up ring with at least one slit. A catching slit running approximately tangentially in the direction of rotation has the advantage that the secure capture of the thread is assured even at high circumferential velocities of the barrel.

In a preferred embodiment, the take-up ring in the retracted state projects at least 1 mm beyond the yarn carrier edge, i.e., beyond the outer edge of the cone. This has the advantage that, in transport and storage, the thread will not become pinched or otherwise damaged at the edge of the barrel.

To form a thread reserve, the take-up ring 4 can be roughened on its surface 4' and in a first, extended, position, the take-up ring will extend beyond the edge of the yarn carrier. The thread from the cylindrical barrel 1 of the yarn carrier contacts the surface 4' of the take-up ring; the winding of the yarn carrier causes thread to be wound on the take-up ring 4. After removal of the yarn carrier from a winder, take-up ring 4 is pushed into a second, contracted, positionfor transport. When it is desired to remove the thread reserve from the take-up ring 4, said take-up ring is drawn out to the first, extended, position and the thread, which runs from take-up ring 4 over the conical end 3 and into the yarn carried on cylindrical barrel 1, is released by a slight rotational movement of the take-up ring. In the extended position, the thread is subject to strain, and the slight rotary movement turns against the strain of said thread.

BRIEF DESCRIPTION OF THE DRAWING

The invention is to be explained by way of example with the aid of a drawing, wherein.

DETAILED DESCRIPTION OF PREFERRED EMBODIMENT

Figure 1:
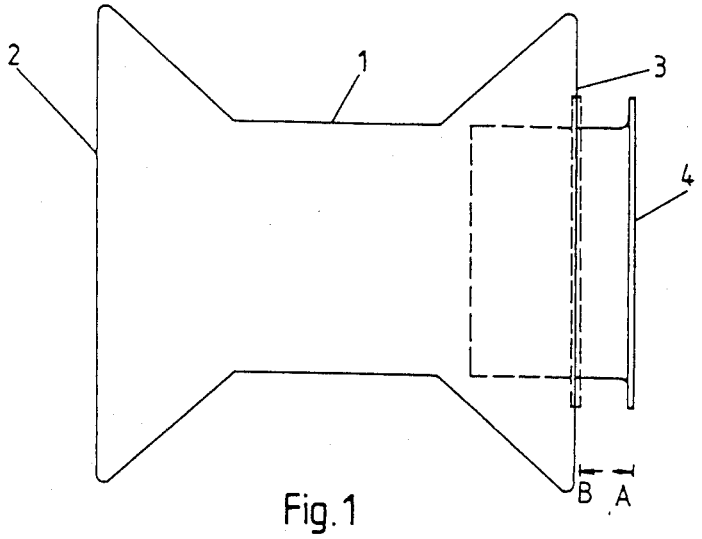
FIG. 1 is a diagrammatic view of a yarn carrier with the take-up ring according to the invention.

In FIG. 1, a cylindrical barrel of a biconical yarn carrier is designated with the reference number 1. The barrel 1 is defined by a conical end 2 and a conical end 3. The barrel 1 with the ends 2 and 3 can be made in one piece. A take-up ring 4 is installed inside of the conical end 3. In the extended state the outer edge of the take-up ring 4 assumes a position A. The position of the take-up ring 4 when retracted is indicated by broken lines. The outer edge of the take-up ring is then in position B.

Figure 2:
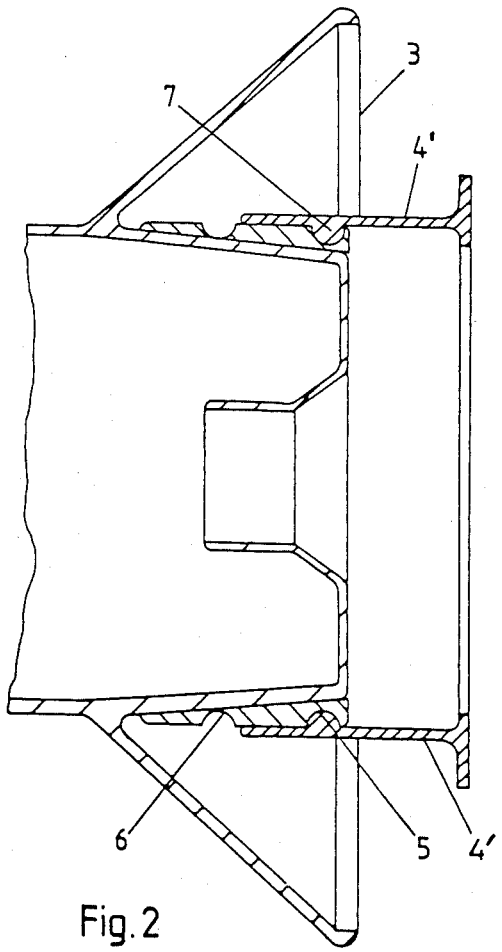
FIG. 2 is a cross-sectional view taken through the yarn carrier in the area of the take-up ring in accordance with FIG. 1.

FIG. 2 illustrates the cylindrical surface 4' of the take-up ring 4. One of the conical ends 3 of the barrel 1 is provided on its interior with at least two parallel annular grooves. The inner annular groove 6 is disposed at a distance AB from the outer annular groove 5. The take-up ring 4 bears on its interior an annular detent 7. The position of the annular detent 7 is such that, when the take-up ring 4 is pushed into the barrel 1, it snaps into the inner annular groove 6. The distance AB is selected such that the axial displacement of the take-up ring 4 enables it to be cleanly wound with a reserve of thread when the annular detent 7 is snapped into the outer annular groove 5.

Figure 3:
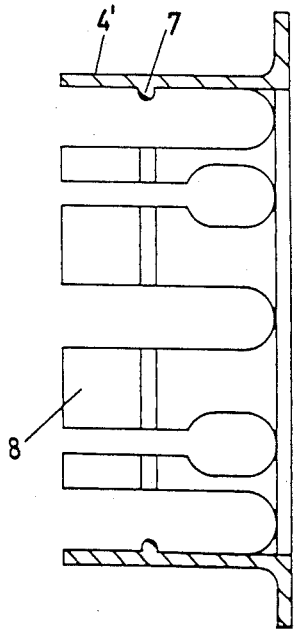
FIG. 3 is a cross-sectional view taken through the take-up ring.

In FIG. 3 the take-up ring 4 is provided with fingers 8 which are configured so as to be resilient, so that insertion into the barrel 1 can be performed securely and quickly.

In operation, the yarn carrier with the take-up ring 4 pulled out from the barrel 1 is mounted on the mandrel of a winder not shown, and accelerated. After the required rotatory speed is reached the thread is guided from a full yarn carrier such that the thread is caught by a slit (not shown) in the outer end of the take-up ring and the rough surface 4' of the take-up ring and the thread reserve is laid on the take-up ring 4, which takes about 0.8 to 1.2 second. Immediately afterward the barrel 1 is wound. The full yarn carrier is removed from the mandrel and the take-up ring 4 is shifted manually or by machine to position B for transport and storage.

Several yarn carriers can be provided on the mandrel of a winder. The yarn carrier according to the invention is especially suited for winding high-speed monofilament threads in the fineness range between 0.05 to 0.3 mm diameter and has proven effective also in the case of threads stretched at high speeds for the automatic changeover from an empty yarn carrier to a full yarn carrier.

It will be understood that the specification and examples are illustrative but not limitative of the present invention in that other embodiments within the spirit and scope of the invention will suggest themselves to those skilled in the art.

What is claimed is:

1. A bobbin for winding a filament thread comprising: a cylindrical barrel having first and second conical ends, a take-up ring having a portion for forming a thread reserve thereon, means mounting the take-up ring in said first conical end of the bobbin for coaxial displacement from a contracted position wherein said thread reserve forming portion is within said first conical end and to an extended position wherein said thread reserve forming portion extends axially beyond said first conical end.

2. The bobbin according to claim 1 wherein the take-up ring has a diameter substantially equal to a diameter of the cylindrical barrel.

3. The bobbin according to claim 1 wherein said first end further comprises an inside wall provided with at least two annular grooves and the take-up ring further comprises a wall having at least one annular detent corresponding to and adapted to snap into the annular grooves.

4. The bobbin according to claim 1 wherein the thread reserve forming portion of the take-up ring further comprises an outer wall which is roughened

5. The bobbin according to claim 2 wherein the take-up ring further comprises an interior portion accommodated in said first conical end having a plurality of axially disposed resilient fingers adapted to cause the take-up ring to fit securely into the cylindrical barrel.

6. The bobbin according to claim 5 wherein each of the fingers has a width of a value substantially equal to a value of a width of another finger.

7. The bobbin according to claim 1 wherein the take-up ring extends at least 1 mm beyond the outer edge of the first conical end when said take-up ring is in the extended position.

8. A bobbin according to claim 7 wherein said take-up ring further comprises an axial wall extending into said first conical end of said cylindrical barrel, said axial wall having an inner surface provided with an annular detent; a plurality of axially disposed resilient fingers, each finger having a width substantially equal to the width of another finger, said fingers adapted to secure said take-up ring in said first conical end of the barrel; and said take-up ring extending at least 1 mm beyond the first concial end when said take-up ring is in said extended position.

9. The bobbin according to claim 8 wherein said bobbin further comprises the first conical end having an inside surface adjacent to said axial wall of the take-up ring, said inside surface having at least two annular grooves adapted to accommodate said detent on said inside surface of said first conical end whereby when said take-up ring is in said extended position, said detent is in one of said annular grooves and when said take-up ring is in said contracted position, said detent is in the other of said annular grooves.

10. A method for forming a filament thread reserve in a cylindrically-barrelled bobbin comprising:

extending a take-up ring from a contracted position within a conical end of the cylindrical barrel to an entended position wherein the take-up ring projects axially beyond said conical end;

winding the filament thread in a space defined by an outer edge of the take-up ring and an outer edge of the conical end; and moving said take-up ring from said extended position to said contracted position inside the conical end of the barrel.

11. A bobbin for winding a filament thread comprising:

(a) a cylindrical barrel having first and second conical ends, said first conical end having an inside surface provided with an inner annular groove and an outer annular groove; and (b) a take-up ring disposed within said first conical end and having an axial wall adjacent to said inside surface of said first conical end, said axial wall having an inner surface provided with a detent corresponding in shape to said inner and said outer annular grooves such that when said detent is disposed within said inner annular groove, said take-up ring is in a contracted position with respect to the cylindrical barrel and when said detent is positioned within said outer annular groove, said take-up ring is in an extended position with respect to the cylindrical barrrel.

* * * * *